US009669629B2

(12) United States Patent
Suzuki

(10) Patent No.: US 9,669,629 B2
(45) Date of Patent: Jun. 6, 2017

(54) INK-JET HEAD AND PRINTER

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Isao Suzuki, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/955,184

(22) Filed: Dec. 1, 2015

(65) Prior Publication Data

US 2016/0159095 A1 Jun. 9, 2016

(30) Foreign Application Priority Data

Dec. 4, 2014 (JP) ..... 2014-246075

(51) Int. Cl.
*B41J 2/14* (2006.01)
*B41J 2/155* (2006.01)

(52) U.S. Cl.
CPC ..... *B41J 2/14201* (2013.01); *B41J 2/1433* (2013.01); *B41J 2/14209* (2013.01); *B41J 2/155* (2013.01); *B41J 2002/14475* (2013.01)

(58) Field of Classification Search
CPC ... B41J 2/14201; B41J 2/14209; B41J 2/1433
See application file for complete search history.

(56) References Cited

U.S. PATENT DOCUMENTS

2005/0219298 A1* 10/2005 Kachi ..... B41J 2/2121 347/15

FOREIGN PATENT DOCUMENTS

JP 2002-15499 * 5/2002 ..... B41J 2/045

* cited by examiner

*Primary Examiner* — Geoffrey Mruk
(74) *Attorney, Agent, or Firm* — Amin, Turocy & Watson LLP

(57) ABSTRACT

In accordance with an embodiment, an ink-jet head is provided which comprises a substrate; a piezoelectric body configured to have a plurality of parallel partition walls at the same pitch interval in the nozzle arrangement direction on the substrate and be plurally arranged in a direction orthogonal to the nozzle arrangement direction; a frame body configured to be arranged on the substrate at the outside of the piezoelectric body; and a nozzle plate configured to have a plurality of discharge openings which is formed by shifting by a half pitch in the nozzle arrangement direction in each row of pressure chambers formed with plural rows by the frame body and a plurality of the partition walls and is respectively formed in the orthogonal direction at a pitch identical to the pitch in each the pressure chamber.

6 Claims, 7 Drawing Sheets

INK-JET HEAD AND PRINTER

CROSS-REFERENCE TO RELATED APPLICATION

This application is based upon and claims the benefit of priority from Japanese Patent Application No. 2014-246075, filed Dec. 4, 2014, the entire contents of which are incorporated herein by reference.

FIELD

Embodiments described herein relate generally to an ink-jet head and a printer.

BACKGROUND

An ink-jet head pressures ink in a pressure chamber and jets droplets from a discharge opening. A printer relating to a related technology makes a large number of ink droplets ejected through a method for enlarging a nozzle diameter. Alternatively, a printer relating to a related technology makes a plurality of nozzles formed in one actuator. There is known a liquid jetting head (for example, refer to Japanese Unexamined Patent Application Publication No. 2009-233879) which includes a nozzle plate provided with a plurality of nozzle opening groups in each pressure-generating chamber as a method for forming a plurality of nozzles. The liquid jetting head is provided with a plurality of nozzle openings for filling an area on a jetting object with a pixel by few liquid amounts.

DESCRIPTION OF THE DRAWINGS

FIG. 2(*b*) is a longitudinal cross-sectional view illustrating the head main body used in the ink-jet head;

FIG. 6(*b*) is a diagram illustrating an image receiving medium surface after a droplet impact thereon through an ink-jet head relating to a related technology.

DETAILED DESCRIPTION

Figure 1:
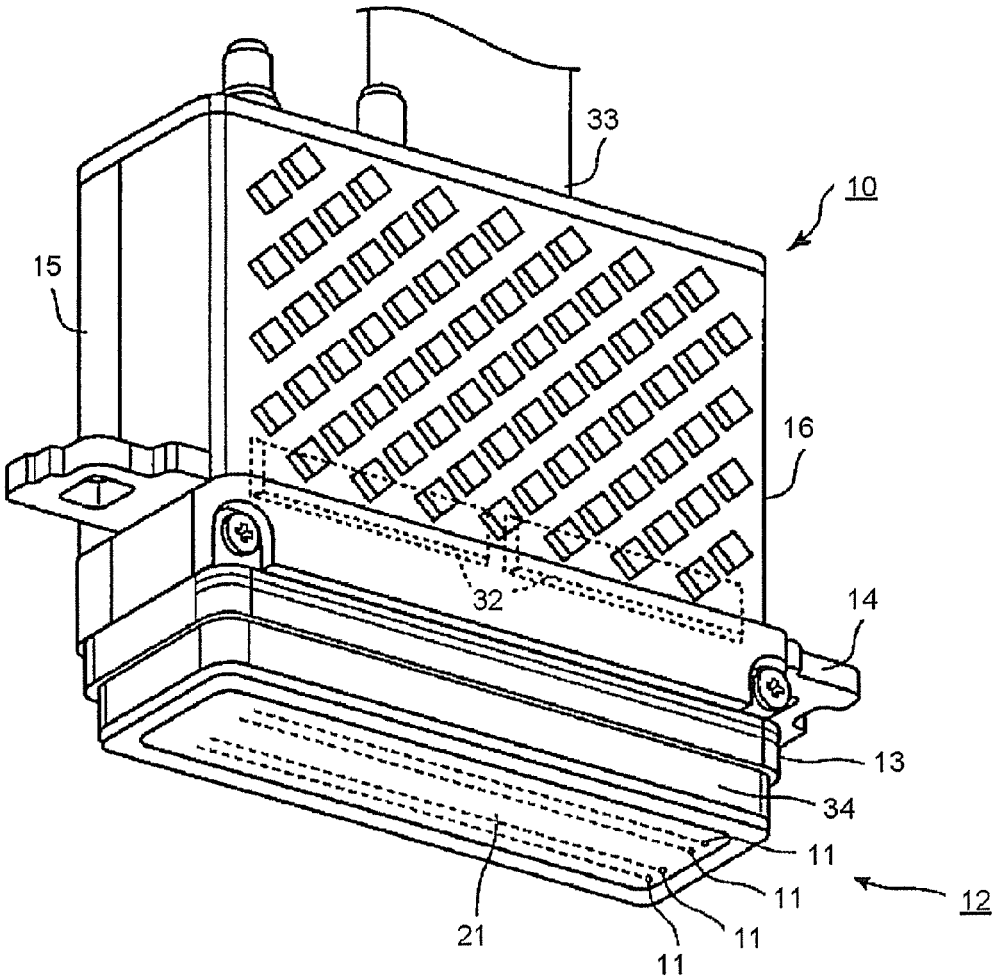
FIG. 1 is a perspective view of an ink-jet head according to an embodiment.

In accordance with an embodiment, an ink-jet head is provided which comprises a substrate, a piezoelectric body configured to have a plurality of parallel partition walls at the same pitch interval in the nozzle arrangement direction on the substrate and be plurally arranged in a direction orthogonal to the nozzle arrangement direction; a frame body configured to be arranged on the substrate at the outside of the piezoelectric body; and a nozzle plate configured to have a plurality of discharge openings which is formed by shifting by a half pitch in the nozzle arrangement direction in each row of pressure chambers formed with plural rows by the frame body and a plurality of the partition walls and is respectively formed in the orthogonal direction at a pitch identical to the pitch in each the pressure chamber.

In accordance with another embodiment, a printer comprises an ink-jet head configured to include a piezoelectric body which has a plurality of parallel partition walls at a pitch interval in a horizontal scanning direction respectively and is plurally arranged in a vertical scanning direction orthogonal to the horizontal scanning direction, and a nozzle plate which has a plurality of discharge openings which is formed by shifting by a half pitch in the horizontal scanning direction in each row of pressure chambers formed with plural rows by the frame body on the substrate and the piezoelectric body and is respectively formed in the vertical scanning direction at a pitch identical to the pitch in each the pressure chamber; a conveyance roller configured to convey an image receiving medium to the ink-jet head relatively; and a controller configured to control the driving of the conveyance roller.

Hereinafter, the ink-jet head and the printer according to the embodiment are described with reference to FIG. 1 to FIG. 7. Further, the same components in each figure are denoted by the same reference numerals and the description thereof is omitted.

One Embodiment

FIG. 1 is a perspective view of an ink-jet head according to the embodiment. An ink-jet head 10 is equipped with a head main body 12 formed with four rows of plural discharge openings 11 arranged in a nozzle arrangement direction, a manifold 13 which supplies/discharges ink to the head main body 12, a reference plate (datum plate) 14 for fixing the direction of a head surface of the head main body 12, and heat sinks 15 and 16. The nozzle arrangement direction refers to a longitudinal direction over left and right of the head main body 12 in the same figure.

Figure 2:
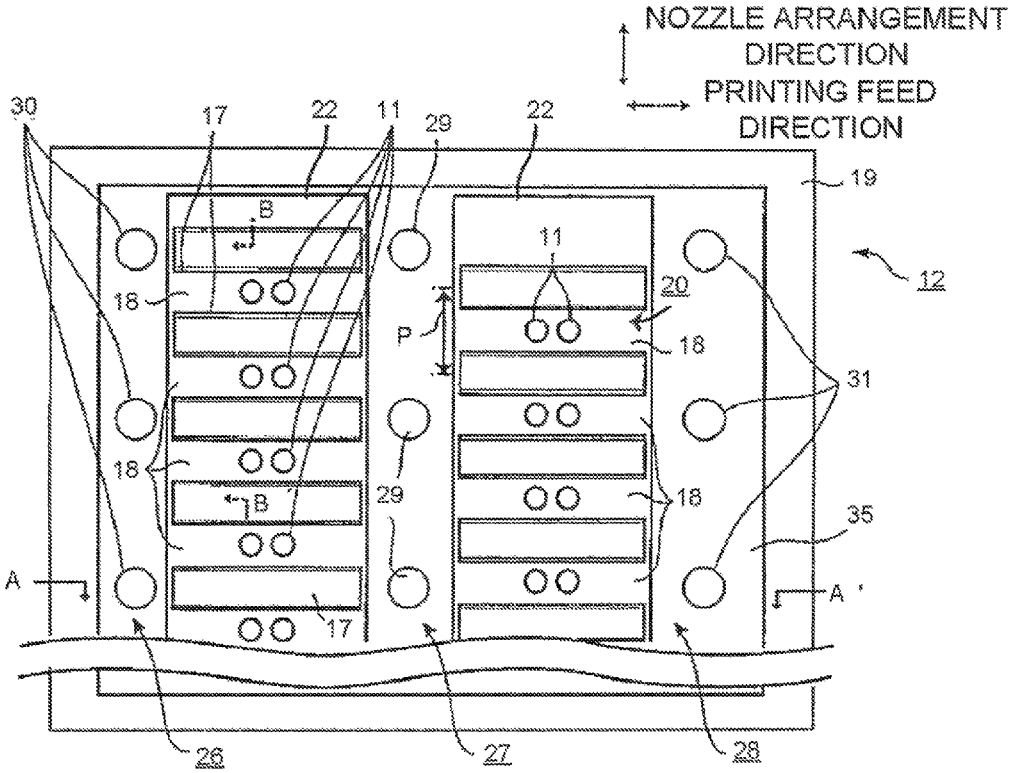
FIG. 2(*a*) is a plane view illustrating a head main body used in the ink-jet head according to the embodiment.
Figure 2:
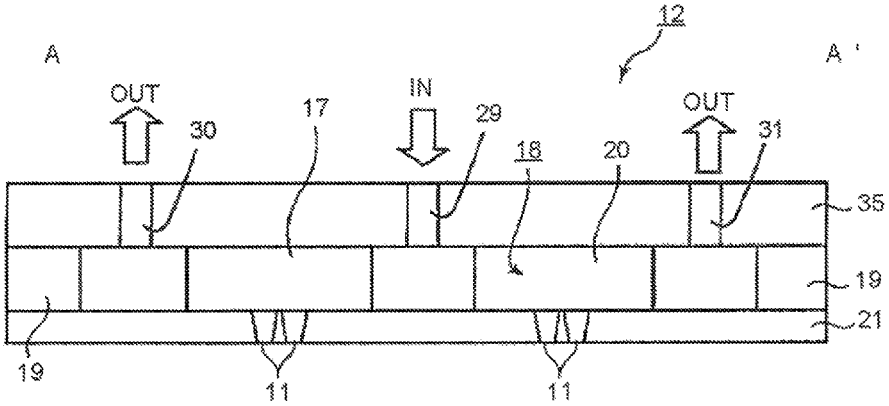
Figure 3:
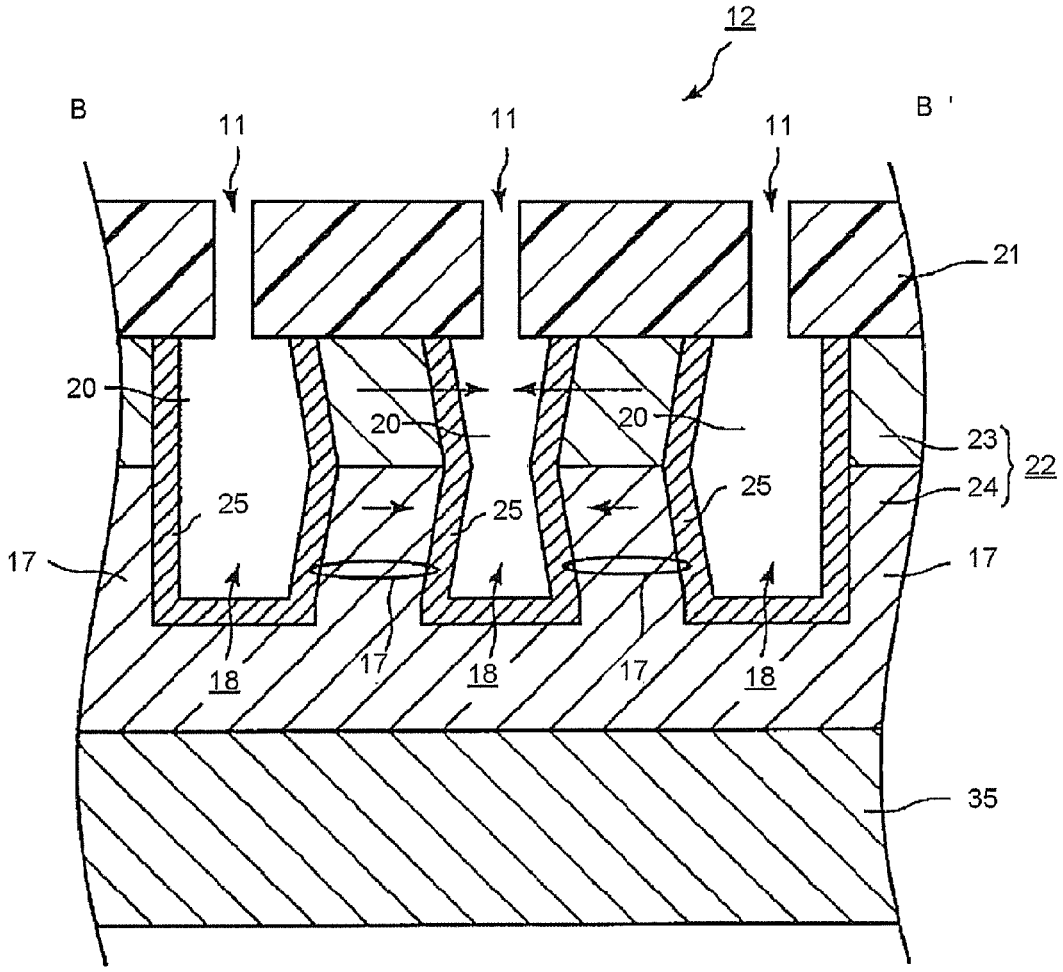
FIG. 3 is another longitudinal cross-sectional view illustrating the head main body used in the ink-jet head according to the embodiment.

FIG. 2(*a*) is a plane view illustrating the head main body 12 of the ink-jet head according to the present embodiment and shows several of 600 actuators 18. FIG. 2(*b*) is a longitudinal cross-sectional view along AA' of FIG. 2(*a*). FIG. 3 is a longitudinal cross-sectional view along BB' of FIG. 2(*a*), and shows that top and bottom is opposite to the example of FIG. 1. The described reference numerals indicate the same elements.

The ink-jet head according to the present embodiment is equipped with a substrate 35; a row of actuators 18, plurally arranged in a printing feed direction orthogonal to the nozzle arrangement direction (piezoelectric body), which has a plurality of parallel partition walls 17 at the same nozzle pitch P (pitch) interval in the nozzle arrangement direction on the substrate 35; and a frame body 19 arranged on the substrate 35 at the outside of these rows of the actuators 18. The ink-jet head is further equipped with a nozzle plate 21 having a plurality of discharge openings 11 which is formed by shifting a half pitch in the nozzle arrangement direction in each row of pressure chambers 20 formed with two rows by the frame body 19 and the rows of the actuators 18 and is respectively formed in the printing feed direction at a pitch identical to the nozzle pitch P in each pressure chamber 20. The half pitch refers to ½ of the nozzle pitch P.

The substrate 35 is abase plate having a substrate surface with insulation property, for example, made from alumina ($AI_2O_3$). Two piezoelectric members 22 are located in parallel on the substrate 35. As shown in FIG. 3, a plurality of partition walls 17 and a plurality of grooves are alternately formed on each piezoelectric member 22. Two piezoelectric plates 23 and 24 of one piezoelectric member 22 are bonded with each other in a thickness direction. Polarization directions of the piezoelectric plates 23 and 24 are opposite to each other. PZT (Lead zirconate titanate) of which piezoelectric constant is high is used in the piezoelectric plates 23 and 24.

The actuator 18 is piezoelectric actuator. The actuator 18 is equipped with rear surface of the nozzle plate 21, pair of a pair of opposite partition walls 17, groove bottom between partition walls 17, partition wall surfaces of these partition walls 17 and conductive film 25 arranged at the groove bottom. The conductive film 25 is arranged for each actuator 18. Each conductive film 25 is electronically connected with any one of four driver ICs 32 on the heat sinks 15 and 16 (refer to FIG. 1) through the substrate 35 (two driver ICs 32 are shown in FIG. 1).

Two piezoelectric members 22 are arranged inside the frame body 19 of FIG. 2. A mask plate 34 (FIG. 1) may be mounted outside the frame body 19. The nozzle plate 21 is supported by the frame body 19 underneath the plate.

Figure 4:
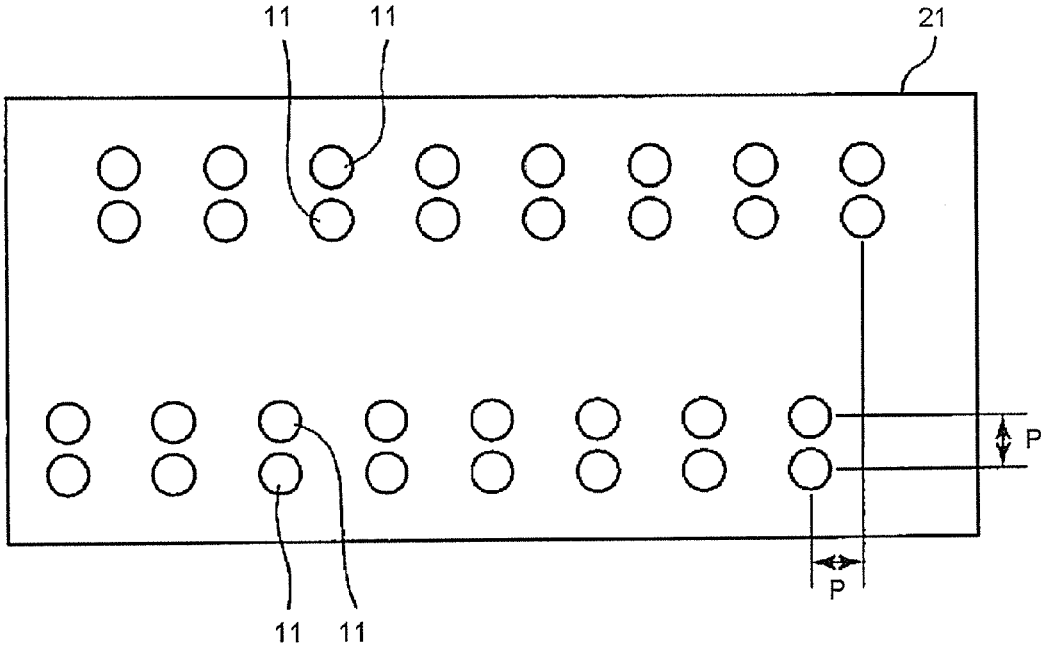
FIG. 4 is a plane view illustrating a nozzle plate of the ink-jet head according to the embodiment.

FIG. 4 is a plane view illustrating the nozzle plate 21 of the ink-jet head according to the present embodiment. The described reference numerals indicate the same elements. Two discharge openings 11 are arranged in each actuator 18. The discharge openings 11 are arranged along a head vertical scanning direction. Interval of the discharge openings 11 in the vertical scanning direction is the same as a dot pitch P in the horizontal scanning direction. The head vertical scanning direction refers to vertical feed direction of paper or printing feed direction. The pitch between two adjacent discharge openings 11 of a first discharge opening row and the pitch between two adjacent discharge openings 11 of a second discharge opening row are shifted by a half pitch from each other. The first discharge opening row is the upper two rows within rows of the discharge openings 11 in four upper and lower rows. The lower two rows are the second discharge opening row.

Further, common liquid chambers 26, 27 and 28 of inks are formed by internal surfaces of the frame body 19, principal surfaces of the substrate 35 and rear surfaces of the nozzle plate 21 of FIG. 2. The inks flow between common liquid chambers 26, 27 and 28 and each pressure chamber 20. The common liquid chamber 27 is communicated with a plurality of through holes for supplying ink. The common liquid chamber 26 is communicated with a plurality of through holes 30 for discharging ink. The common liquid chamber 28 is communicated with a plurality of through holes 31 for discharging ink. Each through hole 29, each through hole 30 and each through hole 31 are communicated with the manifold 13 (FIG. 1).

Figure 5:
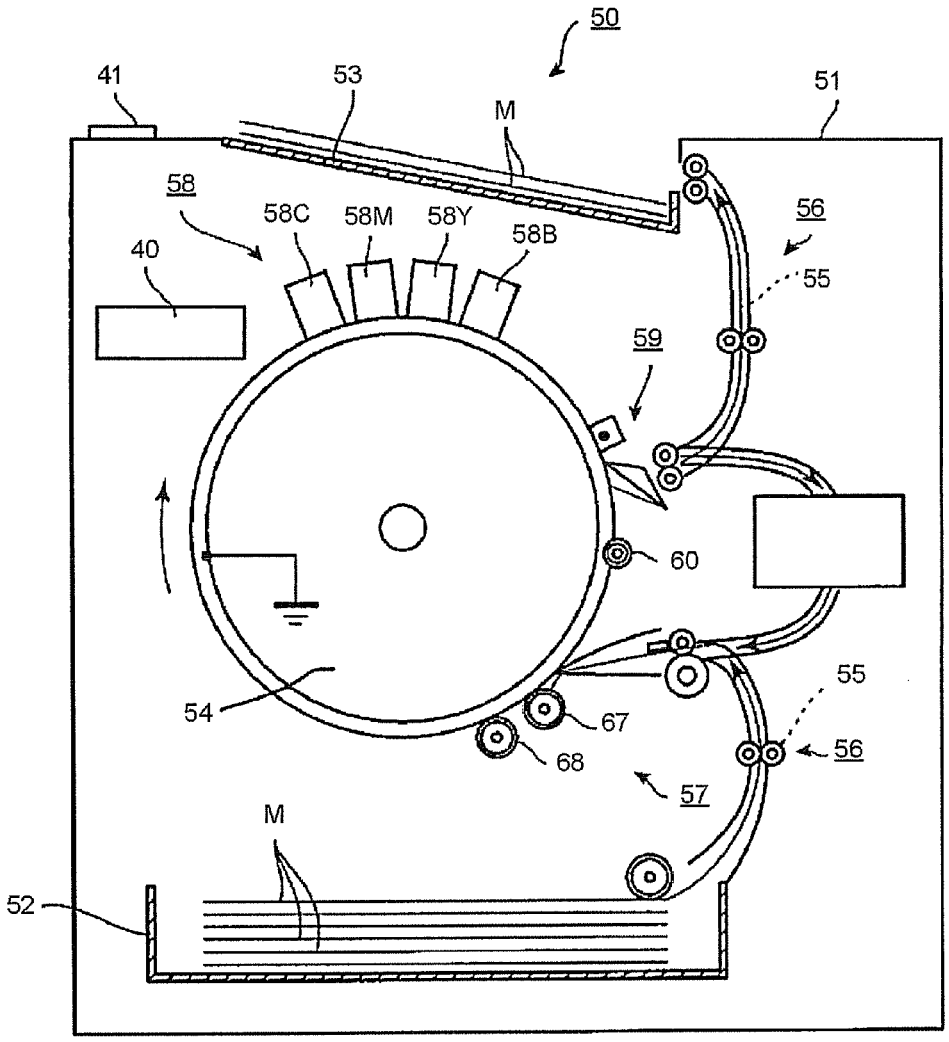
FIG. 5 is a diagram illustrating the structure of a printer according to the embodiment.

The manifold 13 of FIG. 1 includes an ink supply path and an ink discharge path of 2 system at the inside thereof. The ink supply path is communicated with an ink supply tube of a printer 50 (FIG. 5). Each ink discharge path is respectively communicated with an ink discharge tube of the printer 50 side. Each driver IC 32 transmits and receives a signal between the printer 50 through a cable 33. All the actuators 18 can be individually controlled.

FIG. 5 is a diagram illustrating the structure of the printer according to the present embodiment. The printer 50 is a color ink-jet printer jetting the ink with the use of an ink-jet head 10. The printer 50 is provided with a controller 40, a cassette 52, a tray 53, conveyance rollers (conveyance roller pair) 55 and 61 and a conveyance section 56. The conveyance rollers 55 and 61 are a part of the conveyance section 56.

The controller 40 carries out a paper feed control. The controller 40 transmits and receives a control signal between each driver IC 32. The cassette 52 arranged in the lower portion of the housing 51 sets a paper M (image receiving medium) therein. The tray 53 is arranged in the upper portion of the housing 51. A drum 54 rotates in such a manner that the paper M is kept on the peripheral surface of the drum.

The conveyance roller 55 conveys the paper M to ink-jet heads 58C, 58M, 58Y and 58B relatively. The conveyance roller 55 picks up the paper M from the cassette 52 and conveys the picked up paper M in a rotational movement direction of the ink-jet heads 58C, 58M, 58Y and 58B. Circumferential velocity of the conveyance roller 55 is controlled so that paper feed speed of the paper M in the vertical scanning direction becomes 150 dpi. The controller 40 controls the driving of the conveyance section 56.

The printer 50 is equipped with a holding mechanism 57, an image forming section 58, a discharge peeling section 59 and a cleaner 60 from upstream side to downstream side in sequence along the peripheral surface of the drum 54 in a clockwise direction.

The holding mechanism 57 enables the paper M to be absorbed on the peripheral surface of the drum 54. The image forming section 58 forms an image on the paper M. The discharge peeling section 59 discharges the paper M. The cleaner 60 cleans the drum 54.

The image forming section 58 is provided with the ink-jet head 58C for cyan, the ink-jet head 58M for magenta, the ink-jet head 58Y for yellow and the ink-jet head 58B for black. The ink-jet heads 58C, 58M, 58Y and 58B respectively have the same constitution with the ink-jet head 10.

The controller 40 sets a value obtained by multiplying hole opening quantity 2 of the discharge openings in the vertical scanning direction by the paper feed speed 150 dpi of paper M in the vertical scanning direction through the conveyance roller 55 as a printing density in horizontal scanning direction. The printing density refers to a printing fineness of the printer 50 and a value indicated by the number of dots per 1 inch (or 1 mm). That is, the controller 40 sets the paper feed speed 150 dpi in vertical scanning direction to be ½ of the printing density 300 dpi in horizontal scanning direction. The ink-jet heads 58M, 58Y and 58B have the same constitution with the ink-jet head 58C.

Next, the operations of the printer 50 with the abovementioned structure are described.

The controller 40 generates a print job by taking an operation on a user interface 41 by a user as an opportunity. The controller 40 generates data to be printed.

The ink-jet head 58C applies a voltage driving signal to one discharge opening 11. The piezoelectric plates 23 and 24 are deformed and then the deformation is restored. Volume of the pressure chamber 20 is enlarged or reduced through a bending deformation of the partition wall 17. The ink-jet head 58C jets the droplets onto the paper M though hydraulic pressure of the ink.

Figure 6A:
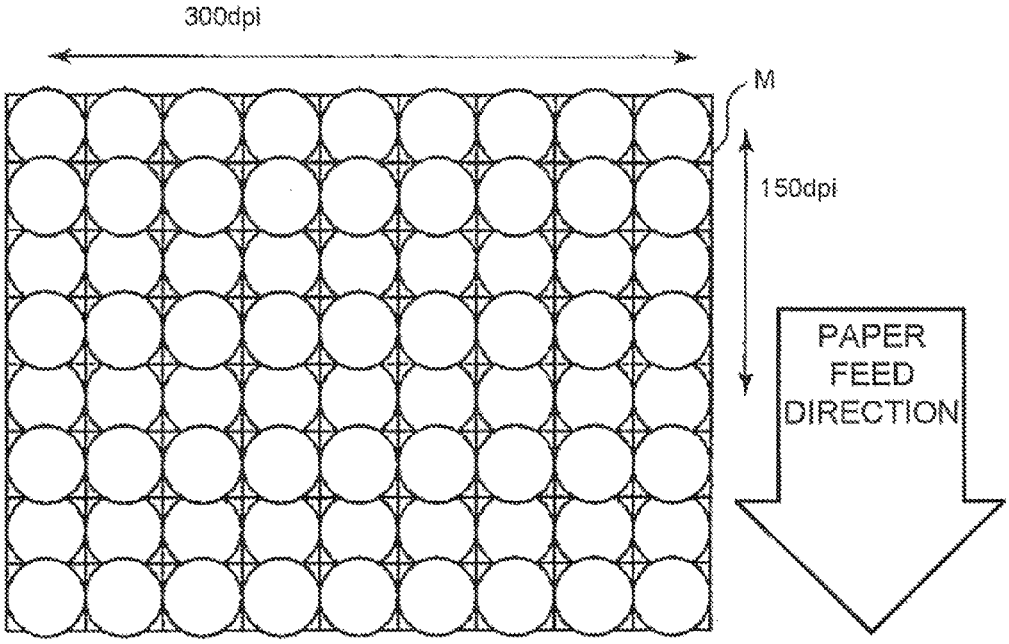
FIG. 6(*a*) is a diagram illustrating an image receiving medium surface after a droplet impact thereon through the ink-jet head according to the embodiment.
Figure 6B:
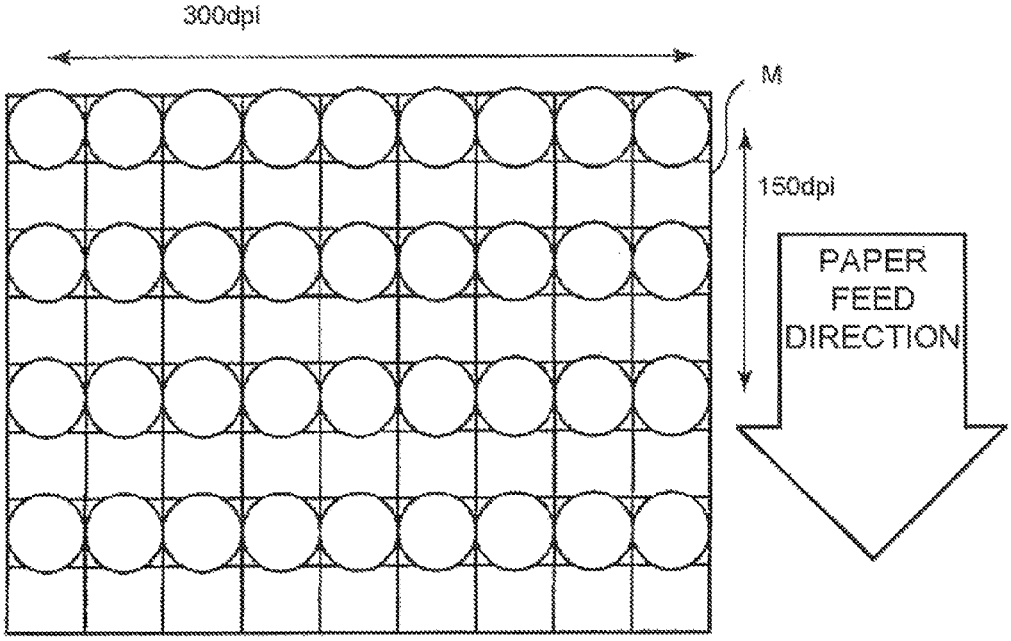

FIG. 6(*a*) is a diagram illustrating a paper surface of the paper M after a droplet impact to the paper surface through the ink-jet head 58C. In FIG. 6(*a*), each direction of the horizontal and vertical (paper feed direction) is the horizontal scanning direction and the vertical scanning direction. For example, the printing density in the horizontal scanning direction of the ink-jet head 58C is 300 dpi. The printing density in the vertical scanning direction of the conveyance section 56 is 150 dpi. The dot pitch P is 84.5 μm, having the same values in the vertical direction and the horizontal direction. One round shape represents a droplet impacted to the paper surface. The still ink-jet head 58C jets the droplets onto the paper M which moves relatively to the still ink-jet head 58C. Through the movement of the paper M with respect to the ink-jet head 58C towards the vertical scanning direction, image data is printed. The ink-jet heads 58M, 58Y and 58B also have the same operations with the ink-jet head 58C.

FIG. 6(*b*) is a diagram illustrating a paper surface of the paper M after a droplet impact to the paper surface through an ink-jet head relating to a related technology. A nozzle plate having a discharge opening in one actuator is exemplified. An impact result indicated by a paper feed speed identical to the paper feed speed shown in FIG. 6(*a*) is exemplified. The printing density in the horizontal scanning direction of the ink-jet head relating to a related technology is 300 dpi. The printing density in the vertical scanning direction of a printer conveyance mechanism is 150 dpi. With the use of any monochromatic ink-jet head relating to the related technology, dot lines in the horizontal scanning direction impact every other row in the paper feed direction as shown in FIG. 6(*b*). Part where the dot line does not exist is generated. In the related technology, a printing density lower than the foregoing printing density can only be obtained.

The printing density obtained by the printer 50 indicates that the dot lines impact onto all the lines in the paper feed direction as shown in FIG. 6(*a*). In a case of one nozzle, pixels in the head vertical scanning direction cannot be filled. On the other hand, in a case of the printer 50, pixels of all the dot lines can be filled.

(Modification)

Figure 7:
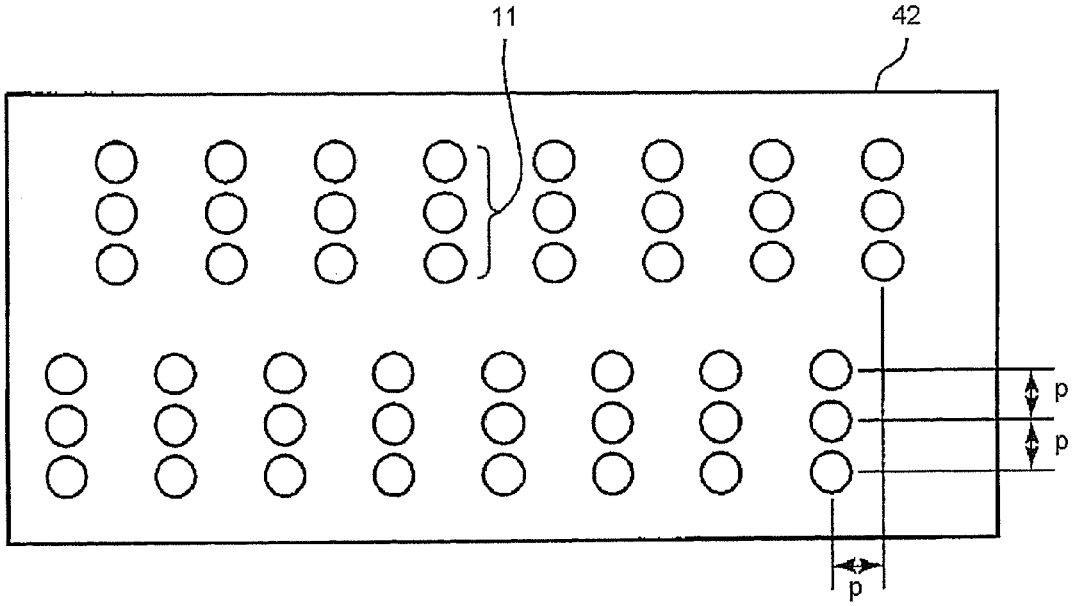
FIG. 7 is a plane view illustrating a nozzle plate of an ink-jet head according to a modification of the embodiment.

FIG. 7 is a plane view of a nozzle plate of an ink-jet head according to a modification. The described reference numerals and signs indicate the same elements.

In the foregoing embodiment, two discharge openings 11 are arranged in each actuator 18. An ink-jet head and a printer may use a nozzle plate 42 in the modification. The nozzle plate 42 has three discharge openings 11 in each actuator 18.

The controller 40 sets a paper feed speed 100 dpi of the paper M in the vertical scanning direction through the conveyance section 56 to be ⅓ of a printing density 300 dpi in the horizontal scanning direction. The printer operates like the example of FIG. 6(*a*).

In the foregoing embodiment and the modification, it is exemplified that the ink-jet head 10 is still in the housing 51 of the printer 50; however, the ink-jet head 10 may move in the horizontal scanning direction with respect to the housing of the printer.

By summarizing the above, the printer 50 arranges the nozzles vertically at a pitch identical to an individual horizontal pitch of the ink-jet head 58C, 58M, 58Y or 58B (hereinafter, referred to as the ink-jet head 58C). Otherwise, the printer 50, in response to resolution at the time of printing, arranges the nozzles at a pitch identical to a scanning pitch. In response to printing speed required for the printer 50, the nozzle quantity of the ink-jet head 58C may be increased.

Two nozzles (discharge openings 11) are formed in each actuator 18 in the printing feed direction. In FIG. 5, when the printing density of one row is 150 dpi, the printing density corresponding to two rows of the ink-jet head 58C is 300 dpi. The distance between the nozzles of the ink-jet head 580 is about 84.5 μm. The interval between the nozzles at the printing direction side is similarly arranged to be 84.5 μm. Even if a printing pitch in the paper feed direction or in the head vertical scanning direction is 150 dpi, the pixels can be filled.

In the foregoing embodiment, the printing pitch (the printing density) is 150 dpi as shown in FIG. 6(*a*); however, the printing pitch of the printer 50 may be 300 dpi. In a case in which the printing pitch is 300 dpi, the ink-jet head 58C jets the droplets twice for the same pixel. High concentration coloring is possible. That is, in a case in which the paper feed speed 300 dpi of the paper M in the vertical scanning direction through the conveyance roller 55 is same as the printing density 300 dpi in the horizontal scanning direction, the controller 40 drives each actuator 18 in each actuator row to eject droplets twice for the same pixel. "Twice" is equal to the hole opening quantity of the discharge openings 11 in the vertical scanning direction.

Further, in a case of seeking for high speed to make the printing pitch larger than 300 dpi, the printer according to the present embodiment may use a nozzle plate of which the nozzle quantity is large at the same pitch. In the foregoing embodiment, the controller 40 respectively sets, in order to guarantee the printing density 300 dpi as a request value, the paper feed speed 150 dpi to be ½ of the printing density 300 dpi, or the paper feed speed 300 dpi to be equal to the printing density 300 dpi, or the paper feed speed 300 dpi to be ⅓ of the printing density 300 dpi; however, the controller 40 may operate the printer 50 at a high speed to make the printing density larger than 300 dpi. For example, in order to guarantee the printing density 400 dpi, if the paper feed speed of the paper Min the vertical scanning direction through the conveyance roller 55 and the printing density in the horizontal scanning direction are both 400 dpi, the controller 40 controls to drive each actuator 18 to jet the droplets at a certain times equal to hole opening quantity of the discharge openings 11 in the vertical scanning direction for the same pixel. The case of either of the printing densities 600 dpi and 1200 dpi is identical to the example of the printing density 400 dpi.

The printer according to the present embodiment can realize both a concentration print and a high-speed print. Generally, on the condition that the paper feed speed and the head feed speed are the same with each other, it is necessary for the printer that a large number of ink droplets are jetted to realize a higher-concentration print. It is desired for the printer to seek for a method for enlarging the nozzle diameter, or to increase the opening quantity of the discharge openings of each actuator and the jetting times.

However, even if the printer relating to the related technology can achieve a dot density, the printing cannot be speeded up. This is because that only increasing the nozzle diameter affects the printing quality. In the related technology, the paper feed speed or the head feed speed cannot be improved. In a case in which the printer relating to the related technology improves the paper feed speed or the head feed speed, the dot lines cannot be entirely covered. The printing quality is deteriorated. In the related technology, the concentration print and the print speed (high-concentration print and the high-speed print) cannot be obtained at the same time.

According to the ink-jet head and the printer of the present embodiment, the ink-jet head 10 arranges two discharge openings 11 in each actuator 18 at a nozzle pitch P of which length and width are same with each other. Even if the paper feed speed is increased, the printer 50 can fill the pixels in response to the paper feed speed.

Further, the printer according to the present embodiment may make the head main body 12 move in the horizontal scanning direction. Even if the head feed speed is increased, the printer according to the present embodiment can fill the pixels in response to the head feed speed. According to the ink-jet head and the printer of the present embodiment, the concentration print and the print speed (high-concentration print and the high-speed print) can be obtained at the same time.

The ink-jet head and the printer according to the present embodiment are applicable to various print fields other than the image forming field with the use of a functional ink. It is particularly effective in a ceramic-oriented print which has high requests on a high-concentration print and a high-speed print.

The arrangement of the discharge openings 11 is not limited to two rows (FIG. 4) or three rows (FIG. 7) and may be one row or four or more rows. Various modifications are possible, and superiorities of the ink-jet head and the printer according to the embodiment are not damaged with respect to embodiments which just carry out these modifications.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. An ink-jet head, comprising:

a substrate;

a piezoelectric body configured to have a plurality of parallel partition walls at the same pitch interval in the nozzle arrangement direction on the substrate and be plurally arranged in a direction orthogonal to the nozzle arrangement direction;

a frame body configured to be arranged on the substrate at the outside of the piezoelectric body; and a nozzle plate configured to have a plurality of discharge openings which is formed by shifting by a half pitch in the nozzle arrangement direction in each row of pressure chambers formed with plural rows by the frame body and a plurality of the partition walls and is respectively formed in the orthogonal direction at a pitch identical to the pitch in each the pressure chamber; and a common liquid chamber configured to be arranged by internal surfaces of the frame body, principal surfaces of the substrate and rear surfaces of the nozzle plate;

wherein the common liquid chamber is communicated with a plurality of first holes for supplying ink, with a plurality of second holes for discharging ink.

2. The ink-jet head according to claim 1, wherein the piezoelectric body is equipped with rear surface of the nozzle plate, pair of the adjacent partition walls among the plural partition walls in the nozzle arrangement direction, groove bottom between partition walls, and a conductive film on the groove bottom and partition wall surfaces of the partition walls.

3. A printer, comprising:

an ink-jet head configured to include a piezoelectric body which has a plurality of parallel partition walls at a pitch interval in a horizontal scanning direction respectively and is plurally arranged in a vertical scanning direction orthogonal to the horizontal scanning direction, and a nozzle plate which has a plurality of discharge openings which is formed by shifting by a half pitch in the horizontal scanning direction in each row of pressure chambers formed with plural rows by the frame body on a substrate and the piezoelectric body and is respectively formed in the vertical scanning direction at a pitch identical to the pitch in each the pressure chamber;

a common liquid chamber configured to be arranged by internal surfaces of the frame body, principal surfaces of the substrate and rear surfaces of the nozzle plate;

wherein the common liquid chamber is communicated with a plurality of first holes for supplying ink, with a plurality of second holes for discharging ink;

a conveyance roller configured to convey an image receiving medium to the ink-jet head relatively; and a controller configured to control the driving of the conveyance roller.

4. The printer according to claim 3, wherein the controller sets a value obtained by multiplying hole opening quantity of the discharge openings in the vertical scanning direction by a paper feed speed of the image receiving medium in the vertical scanning direction through the conveyance roller as a printing density in horizontal scanning direction.

5. The printer according to claim 4, wherein the controller controls to drive each pressure chamber of the piezoelectric body to jet droplets at a certain times equal to hole opening quantity of the discharge openings in the vertical scanning direction for the same pixel in a case in which the paper feed speed of the image receiving medium in the vertical scanning direction through the conveyance roller is identical to the printing density in the horizontal scanning direction.

6. The printer according to claim 3, wherein the controller controls to drive each pressure chamber of the piezoelectric body to jet droplets at a certain times equal to hole opening quantity of the discharge openings in the vertical scanning direction for the same pixel in a case in which the paper feed speed of the image receiving medium in the vertical scanning direction through the conveyance roller is identical to the printing density in the horizontal scanning direction.

* * * * *